US009677562B2

(12) United States Patent
McManus et al.

(10) Patent No.: US 9,677,562 B2
(45) Date of Patent: Jun. 13, 2017

(54) STEPPED BALANCE RING FOR A SUBMERSIBLE WELL PUMP

(71) Applicant: Baker Hughes Incorporated, Houston, TX (US)

(72) Inventors: David F. McManus, Broken Arrow, OK (US); Brown Lyle Wilson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 671 days.

(21) Appl. No.: 14/158,151

(22) Filed: Jan. 17, 2014

(65) Prior Publication Data

US 2015/0204336 A1 Jul. 23, 2015

(51) Int. Cl.

| | |
|---|---|
| ***F04D 13/10*** | (2006.01) |
| ***F04D 29/04*** | (2006.01) |
| ***F04D 1/06*** | (2006.01) |
| ***F04D 17/10*** | (2006.01) |
| ***E21B 43/12*** | (2006.01) |
| ***F04D 29/041*** | (2006.01) |
| ***F04D 29/08*** | (2006.01) |

(52) U.S. Cl.

CPC ..... *F04D 17/10* (2013.01); *E21B 43/126* (2013.01); *E21B 43/128* (2013.01); *F04D 1/06* (2013.01); *F04D 1/063* (2013.01); *F04D 13/10* (2013.01); *F04D 29/041* (2013.01); *F04D 29/0413* (2013.01); *F04D 29/0416* (2013.01); *F04D 29/086* (2013.01)

(58) Field of Classification Search

CPC .... F04D 13/10; F04D 29/0413; F04D 29/445; F04D 1/06; F04D 29/041; F04D 29/0416; E21B 43/128; E21B 43/126

USPC ..... 415/104, 106, 171.1; 416/181

See application file for complete search history.

(56) References Cited

U.S. PATENT DOCUMENTS

| | | | |
|---|---|---|---|
| 6,106,224 | A | 8/2000 | Sheth et al. |
| 6,193,462 | B1 | 2/2001 | Kubota |
| 6,676,366 | B2 | 1/2004 | Kao |
| 6,726,449 | B2 | 4/2004 | James et al. |
| 7,775,763 | B1 | 8/2010 | Johnson et al. |
| 2009/0092478 | A1 | 4/2009 | Eslinger |
| 2011/0055929 | A1 | 3/2011 | Bardet et al. |
| 2011/0058928 | A1 | 3/2011 | Sheth et al. |
| 2011/0255951 | A1 | 10/2011 | Song et al. |

OTHER PUBLICATIONS

International Search Report with Written Opinion as issued in related PCT Patent Application No. PCT/US2014/067077; mailed Mar. 13, 2015; 15 pages.

*Primary Examiner* — Mark A Laurenzi
*Assistant Examiner* — Wesley Harris
(74) *Attorney, Agent, or Firm* — Bracewell LLP; James E. Bradley

(57) ABSTRACT

An electrical submersible pump assembly includes a centrifugal pump having stages. Each of the stages has an impeller in cooperative engagement with a downstream diffuser. The impeller is axially movable relative to the downstream diffuser between a downthrust and an upthrust position. The downstream diffuser has an annular downstream wall surface, relative to the impeller, defining a downstream cavity. The impeller has a downstream balance ring that locates alongside the downstream wall surface. An annular clearance between the downstream balance ring and the downstream wall surface increases in response to the impeller moving from the downthrust to the upthrust position.

18 Claims, 4 Drawing Sheets

STEPPED BALANCE RING FOR A SUBMERSIBLE WELL PUMP

FIELD OF THE DISCLOSURE

This disclosure relates in general to electrical submersible pumps for wells and in particular to a centrifugal pump stage having an impeller balance ring that varies a flow area of a flow path between the balance ring and diffuser in response to whether the thrust is upward or downward directed.

BACKGROUND

Electrical submersible pumps (ESP) are widely used to pump oil production wells. A typical ESP has a rotary pump driven by an electrical motor. A seal section is located between the pump and the motor to reduce the differential between the well fluid pressure on the exterior of the motor and the lubricant pressure within the motor. A drive shaft, normally in several sections, extends from the motor through the seal section and into the pump for rotating the pump. The pump may be a centrifugal pump having a large number of stages, each stage having an impeller and diffuser.

During operation, the impellers create thrust, which can be downthrust, which acts in an upstream direction and upthrust, which acts in a downstream direction. The impellers transmit the upthrust and downthrust in various manners to the diffusers. If the thrust is severe, wear occurs between the thrust surfaces of the impellers and diffusers. The wear is exacerbated if the well fluid contains abrasive sand particles. Thrust surfaces formed of abrasion resistant material, such as tungsten carbide, may be employed in pumps for use in sand laden wells. Abrasion resistant material thrust surfaces add to the cost of the pump.

The impeller of each stage may have a downstream balance ring that extends into the next downstream diffuser. The downstream balance ring fits closely alongside a wall surface of the downstream diffuser. The close engagement of the downstream balance ring and the diffuser wall surface defines a downstream pressure cavity between the downstream diffuser and the impeller. The close engagement restricts communication of fluid being discharged from the impeller vane passages with fluid in the downstream pressure cavity. The clearance between the downstream balance ring and the diffuser wall surface remains constant whether the impeller is in downthrust or upthrust.

Balance holes may extend through a shroud or downstream side of the impeller, communicating fluid pressure in the vicinity of the intake of the impeller with the downstream pressure cavity. Also, each impeller may have an upstream skirt that is closely spaced from a guide surface of the next upstream diffuser.

SUMMARY

The submersible pump assembly of this disclosure includes a submersible motor. A centrifugal pump is operatively connected to the motor. The pump has a longitudinal axis and a plurality of stages. Each of the stages comprises an impeller in cooperative engagement with a downstream diffuser, the impeller being axially movable relative to the downstream diffuser between a downthrust and an upthrust position. The downstream diffuser has an annular downstream wall surface, relative to the impeller, defining a downstream cavity. The impeller has a downstream balance ring that locates alongside the downstream diffuser wall surface. An annular clearance between the downstream balance ring and the downstream diffuser wall surface increases in response to the impeller moving from the downthrust to the upthrust position.

In the preferred embodiment, the downstream wall surface has an annular downstream diffuser rib. The downstream balance ring has an annular impeller downstream rib that is juxtaposed with the downstream diffuser rib while the impeller is in the downthrust position, defining a minimum dimension of the annular clearance. The impeller downstream rib moves downstream of the downstream diffuser rib while the impeller is in the upthrust position, defining a maximum dimension of the annular clearance.

In the examples shown, the downstream wall surface faces inward toward the axis and the annular downstream diffuser rib protrudes inward. The impeller downstream rib protrudes outward and has an axial dimension that is substantially the same as the axial dimension of the downstream diffuser rib.

In one of the embodiments, a plurality of annular downstream diffuser ribs are axially spaced apart from each other by annular downstream diffuser grooves. A plurality of annular impeller downstream ribs are axially spaced apart from each other by annular impeller downstream grooves. The impeller downstream ribs axially align with the downstream diffuser ribs, and the impeller downstream grooves axially align with the downstream diffuser grooves while the impeller is in the downthrust position. The impeller downstream ribs axially align with the downstream diffuser grooves, and the impeller downstream grooves axially align with the downstream diffuser ribs while the impeller is in the upthrust position.

The impeller has an impeller shroud on a downstream side of the impeller. A plurality of vane passages extend outward from a central intake to an impeller periphery. A plurality of balance holes extend through the impeller shroud from the vane passages and are in fluid communication with the downstream cavity. Fluid within the downstream cavity is in fluid communication via the annular clearance with fluid discharged from the vane passages. The increase in the annular clearance that occurs while the impeller moves from the downthrust position toward the upthrust position increases a fluid pressure in the downstream cavity, which acts on the shroud tending to return the impeller to the downthrust position. The decrease in the annular clearance that occurs while the impeller moves from the upthrust position toward the downthrust position reduces a fluid pressure in the downstream cavity, tending to return the impeller toward the upthrust position.

In another embodiment, each stage includes an upstream diffuser having an annular upstream cavity, relative to the impeller, with an annular wall surface. An annular upstream balance ring is located on the impeller. An annular clearance between the upstream balance ring and the wall surface of the upstream cavity decreases in response to the impeller moving from the downthrust to the upthrust position.

The impeller also has an annular upstream skirt on the impeller that has a cylindrical wall surface spaced with a guide surface clearance from a guide surface of the upstream diffuser. The guide surface clearance remains constant while the impeller moves between the downthrust and upthrust positions.

DETAILED DESCRIPTION OF THE DISCLOSURE

Figure 1:
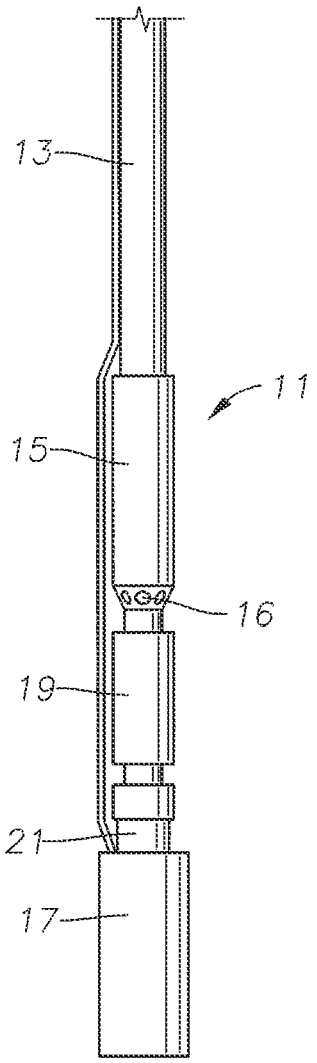
FIG. 1 is a side view of an electrical submersible pump assembly in accordance with this disclosure.

Referring to FIG. 1, electrical submersible pump assembly (ESP) 11 is illustrated as being supported on production tubing 13 extending into a well. Alternately, ESP 11 could be supported by other structure, such as coiled tubing. ESP 11 includes several modules, one of which is a rotary pump 15 that is illustrated as being a centrifugal pump. Pump 15 has an intake 16 for drawing in well fluid. Another module is an electrical motor 17, which drives pump 15 and is normally a three-phase AC motor. A third module comprises a protective member or seal section 19 coupled between pump 15 and motor 17. Seal section 19 has components to reduce a pressure differential between dielectric lubricant contained in motor 17 and the pressure of the well fluid on the exterior of ESP 11. Intake 16 may be located in an upper portion of seal section 19 or on a lower end of pump 15. A thrust bearing unit 21 for motor 17 may be in a separate module or located in seal section 19 or motor 17.

ESP 11 may also include other modules, such as a gas separator for separating gas from the well fluid prior to the well fluid flowing into pump 15. If so, intake 16 would be in the gas separator. The various modules may be shipped to a well site apart from each other, then assembled with bolts or other types of fasteners.

Figure 2:
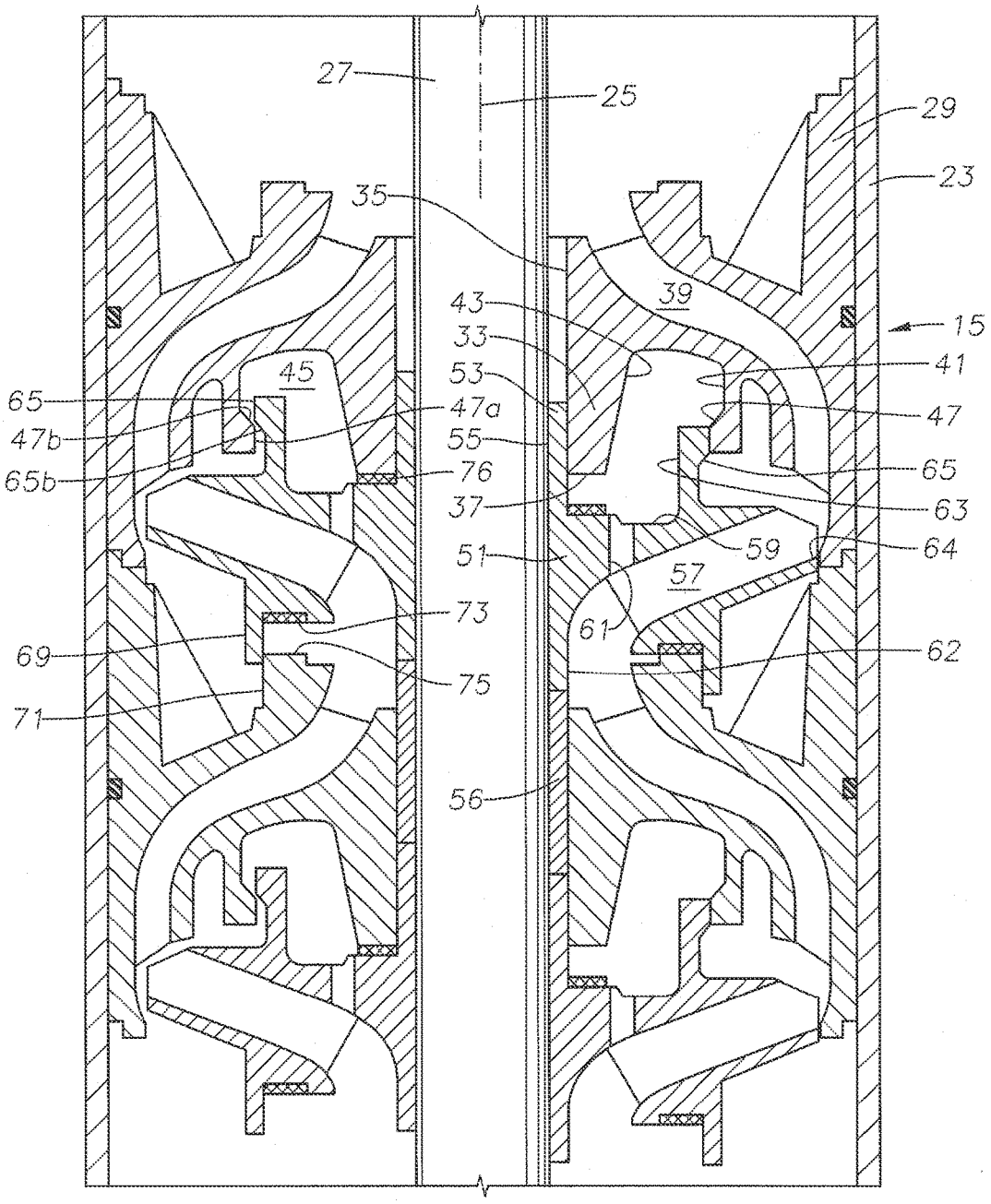
FIG. 2 is a sectional view of two stages of the pump of the pump assembly of FIG. 1, illustrating a first embodiment of an impeller balance ring, with the left side showing the impellers undergoing upthrust and the right side showing downthrust.

Referring to FIG. 2, pump 15 includes a housing 23 that is cylindrical, has a longitudinal axis 25, and is much longer than its diameter. A drive shaft 27 extends along longitudinal axis 25 through housing 23 and is rotated by motor 17. Shaft 25 is normally made up of several sections, one for each of the modules, and connected together with splined ends. A large number of stages are normally within housing 23, each stage including a nonrotating diffuser 29. Diffusers 29 are stacked on one another and secured against rotation in housing 23. Diffusers 29 have central hubs 33, each having a bore through which shaft 27 passes. Hub 33 has an upthrust surface 37 facing in an upstream direction. In the examples shown, diffuser 29 is a mixed flow type, having diffuser flow passages 39 that incline downstream and inward toward axis 25. In radial flow types, which are not shown, diffuser flow passages 39 lead primarily in radial directions rather than inclining.

Diffuser 29 has in its interior an inward-facing wall surface 41 that may be generally cylindrical and is located radially inward from diffuser flow passages 39. Diffuser hub 33 has an outward-facing wall surface 43 that is illustrated as being conical, but could be other shapes. The downstream ends of wall surfaces 41, 43 are joined, defining an annular pressure cavity 45 that is open on the upstream side.

Inward-facing wall surface 41 has an annular downstream diffuser rib 47 on its upstream end that protrudes toward outward-facing wall surface 43. In this embodiment, diffuser rib 47 has cylindrical portion 47*a*; a conical portion 47*b* joins and extends downstream from cylindrical portion 47*a*. Conical portion 47*b* inclines downstream and outward from cylindrical portion 47*a*. The inner diameter of inward-facing wall surface 41 immediately downstream from conical portion 47*b* is greater in diameter than cylindrical portion 47*a*.

An impeller 51 locates between a downstream and an upstream one of the diffusers 29. The terms "upper", "lower" and the like may be used herein but only for convenience, since pump 15 could be operated horizontally. The term "downstream diffuser" refers to the diffuser 29 located immediately downstream of a particular one of the impellers 51. The term "upstream diffuser" refers to the diffuser 29 located immediately upstream a particular one of the impellers 51. Thus as used herein, the term "upstream" refers to structure located upstream from impeller 51, and the term "downstream" refers to structure located immediately downstream from impeller 51.

Impeller 51 has an impeller hub 53 with a bore 55 through which shaft 27 passes. Impeller hub 53 is fixed to shaft 27 for rotation in unison, such as by a key (not shown). However, impeller 51 is free to move axially or float on shaft 27 limited distances between the upthrust position shown in the left side of FIG. 2 and the downthrust position shown on the right side of FIG. 2. Hub 53 extends downstream into diffuser bore 35 of the next downstream diffuser 29. Tubular spacers 56 may be employed to extend into diffuser bores 35 and link each impeller hub 53 with impellers 51 upstream and downstream from it. Impellers 53 generally move axially on shaft 27 in unison with each other. The spacer located above the downstream impeller 51 of FIG. 2 is not shown.

Impeller 51 has impeller or vane passages 57 that incline downstream and outward. The downstream side of impeller 51, referred to herein as an impeller shroud 59, closes the downstream sides of vane passage 57. The upstream sides of vane passages 57 are also closed in this example. A balance hole 61 extends from each vane passage 57 through impeller shroud 59. Balance holes 61 may be parallel with axis 25 and are located at a point radially closer to an impeller central intake 62 than a periphery 64 of impeller 51, which is where vane passages 57 discharge.

Impeller 51 has a downstream balance ring 63 extending downstream from impeller shroud 59. Downstream balance ring 63 is concentric with axis 25 and located radially outward from balance holes 61. In this example, downstream balance ring 63 is located about half the distance from hub 53 to impeller periphery 64. Downstream balance ring 63 has an annular impeller downstream rib 65 on its outer diameter at its downstream end. Downstream impeller rib 65 has a cylindrical surface 65*a*. A conical surface 65*b* may join cylindrical surface 65*a* and incline upstream to a cylindrical outer diameter portion of downstream balance ring 63. The cylindrical surface 65*a* of impeller downstream rib 65 is only slightly less in outer diameter than the inner diameter of downstream diffuser rib cylindrical surface 47*a*. As an example, the difference in diameter may only be about 0.004 to 0.008 inches measured radially on a side. The axial dimension or height of impeller rib cylindrical surface 65*a* may be the same as diffuser rib cylindrical surface 47*a*. The inclination angle of impeller rib conical surface 47*b* may be the same as the inclination angle of diffuser rib conical surface 65*b*. Downstream balance ring 63 and a downstream side of impeller shroud 59 define remaining portions of downstream pressure cavity 45.

Impeller 51 has a skirt 69 that extends upstream from an upstream side of impeller 51. Skirt 69 is a cylindrical member concentric with axis 25. In this embodiment, skirt 69 has an inner diameter that engages a cylindrical guide surface 71 formed on the next upstream diffuser 29. The inner diameter of skirt 69 is only slightly greater than the outer diameter of diffuser guide surface 71, creating a small clearance. The clearance does not change while impeller 51 moves from the maximum downthrust position on the right side of FIG. 2 to the maximum upthrust position of the left side. Although skirt 69 is shown located on the outer diameter of guide surface 71, that arrangement could be reversed, with an outer diameter of skirt 69 engaging an inner diameter of guide surface 71. The outer diameter of skirt 69, as shown, is approximately the same as the outer diameter of downstream balance ring rib 65, but that could be changed.

A flat, annular downthrust surface 73 is formed on upstream diffuser 29 immediately inward of guide surface 71. A downthrust washer 75 is located between downthrust surface 73 and a downthrust surface of impeller 51 immediately inward from skirt 69. An upthrust washer 76 is located between an upthrust portion of impeller 51 and upthrust surface 37 of the next downstream diffuser 29. Downthrust washer 75 and upthrust washer 76 need not be bonded to either impeller 51 or either diffuser 29, thus are free to either rotate with impeller 51 or remain non rotating.

In operation, as impeller 51 rotates with shaft 27, well fluid from the next upstream diffuser 29 flows into impeller intake 62. Impeller 51 discharges the well fluid at a higher velocity and pressure from vane discharges at its periphery 64. The discharged well fluid flows into diffuser passages 39 of the next downstream diffuser 29. Balance holes 61 communicate pressure of vane passages 57 near intake 62 with downstream pressure cavity 45.

Downthrust on impeller 51 occurs during operation. In the maximum downthrust position shown on the right, the upstream side of impeller 51 exerts an upstream directed force on downthrust washer 75 and diffuser downthrust surface 73. At full downthrust, impeller downstream balance ring rib 63 is in registry with and at the same axial position as downstream diffuser rib 47. The close clearance between impeller rib cylindrical surface 65*a* and diffuser rib cylindrical surface 47*a* essentially forms a seal for downstream pressure cavity 45. Fluid in pressure cavity 45 will be restricted from flowing past ribs 47, 63 to the vicinity of impeller periphery 64 area and vice versa. Balance holes 61 will communicate the lower pressure of fluid in vane passages 57 near intake 62 with pressure cavity 45. The lower pressure near impeller intake 62, which is less than at impeller periphery 64, causes bleeding of pressure from pressure cavity 45 through balance holes 61 to the lower pressure region in vane passages 57. This bleeding of fluid lowers the pressure in downstream pressure cavity 45 and reduces the upstream directed force that the pressure in downstream pressure cavity 45 applies to impeller 51. The reduction in upstream directed force lessens the downthrust imposed through downthrust washer 73 to upstream diffuser downthrust surface 75. The reduced upstream directed force reduces wear on the downthrust surface of impeller 51, on diffuser downthrust washer 73, and on diffuser downthrust surface 75, particularly if the well fluid contains abrasive sand particles.

For various reasons, upthrust also occurs during operation, particularly at higher flow rates. As shown on the left side of FIG. 2, during upthrust, impellers 51 move downstream relative to diffusers 29. When impeller 51 reaches the full upthrust position, upthrust washer 76 will transmit a downstream directed force imposed by impeller 51 to upthrust surface 37. Approximately at this full upthrust position, impeller rib 65 will have moved to a point where its cylindrical surface 65*a* is downstream from diffuser rib cylindrical surface 47*a*, as shown on the left side of FIG. 2. A clearance or flow path between conical surfaces 47*b* and 65*b* opens. Fluid in downstream pressure cavity 45 is now in fluid communication with the higher pressure fluid at impeller periphery 64, increasing the fluid pressure in downstream pressure cavity 45. The increased fluid pressure in downstream pressure cavity 45 increases an upstream directed force on impeller 51, which reduces the upthrust force imposed on upthrust washer 76. The increased upstream directed force also tends to push impeller 51 upstream toward the downthrust position shown on the right side of FIG. 2. The reduction in upthrust force reduces wear on upthrust washer 76, diffuser upthrust surface 37 and the upthrust surface of impeller 51. Varying conditions will cause impellers 51 to modulate back and forth between maximum downthrust and maximum upthrust positions.

Figure 3:
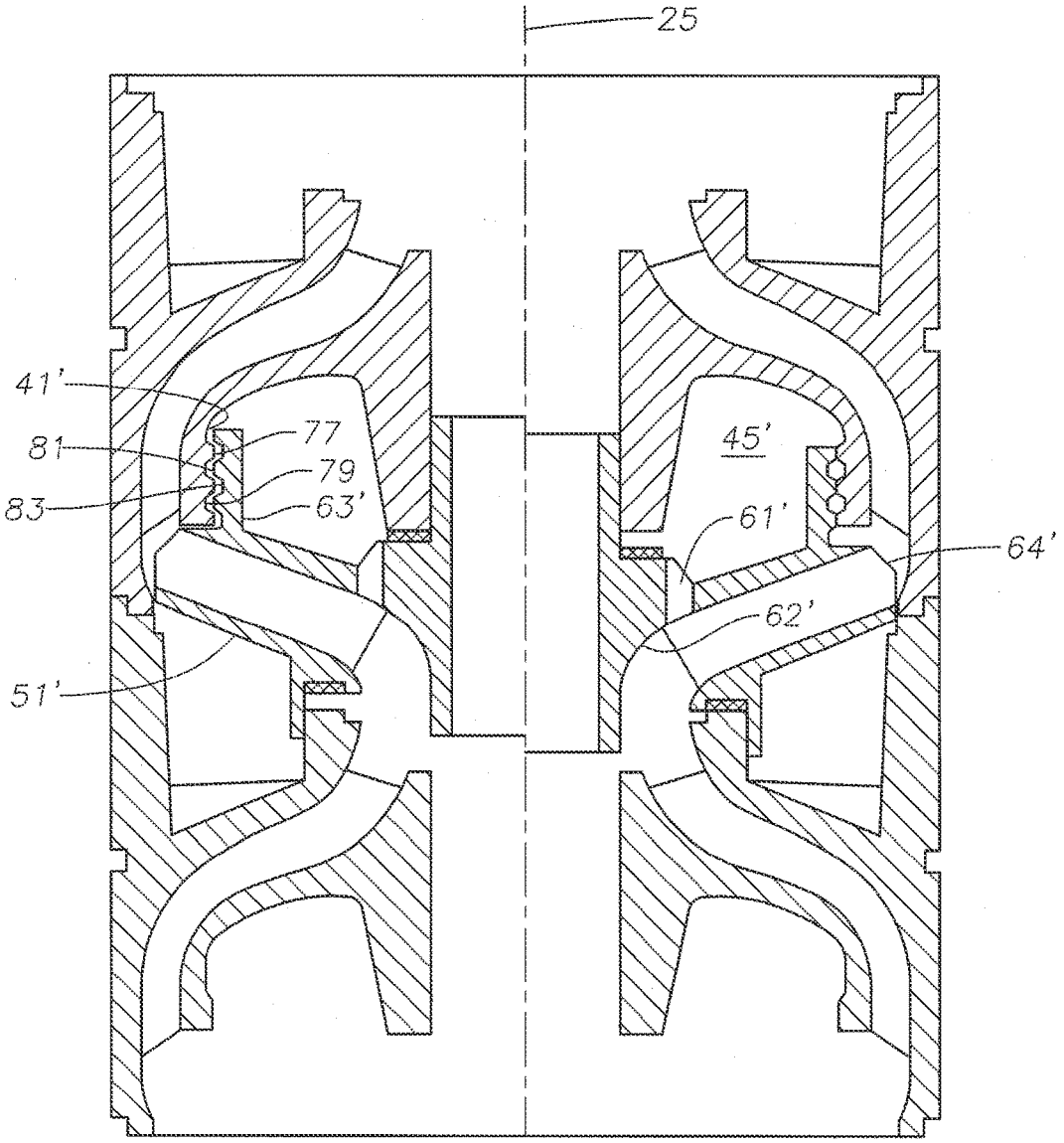
FIG. 3 is a sectional view of one of the pump stages of the pump assembly of FIG. 1, illustrating a second embodiment of an impeller balance ring, with the left side showing the impeller undergoing upthrust and the right side showing downthrust.

FIG. 3 shows a first alternate embodiment, with the shaft and housing not illustrated, and only a single impeller shown. Components that are essentially the same as in FIG. 2 will use the same reference numerals, but with a prime symbol. In this embodiment, a plurality of downstream diffuser ribs 77 are employed, rather than a single diffuser rib 47 as in FIG. 2. Each downstream diffuser rib 77 is an annular protrusion on the diffuser inward-facing wall surface 41' concentric with axis 25. Downstream diffuser ribs 77 are axially spaced apart from each other, defining an diffuser groove 79 between each. This embodiment shows three downstream diffuser ribs 77 and two diffuser grooves 79, but the number can vary. Diffuser grooves 79 have the same axial dimension as each downstream diffuser rib 77. The base of each diffuser groove 79 is approximately the same diameter as the inward-facing wall surface 41' directly downstream from diffuser ribs 77.

Also, impeller 51 has a plurality of impeller downstream ribs 81 rather than a single impeller downstream rib 65 as shown in FIG. 2. Each impeller downstream rib 81 is an annular external protrusion on downstream balance ring 63'. Impeller downstream ribs 81 are axially spaced apart from each other by impeller grooves 83. This embodiment shows three impeller downstream ribs 81 and two impeller grooves 83, but the number may vary. The axial dimensions of impeller downstream ribs 81 and grooves 83 are the same as downstream diffuser ribs 77 and grooves 79.

During the maximum downthrust position shown in the right side of FIG. 3, impeller downstream ribs 81 are in axial alignment with downstream diffuser ribs 77. The close proximity of the cylindrical surfaces of impeller downstream ribs 81 and downstream diffuser ribs 77 restricts and substantially seals any fluid from flowing past impeller ribs 81 and diffuser ribs 77. Fluid pressure in downstream pressure cavity 45' will not be in communication with the higher pressure at impeller periphery 64'. Fluid pressure in downstream pressure cavity 45' will decrease due to communication via balance holes 61' with lower pressure at the impeller intake area 62'. The reduction in fluid pressure in downstream pressure cavity 45' lowers the downthrust force imposed on impeller 51', making is easier for impeller 51' to move upstream from the maximum downthrust position.

The left side of FIG. 3 shows impeller 51' in the full upthrust position. Impeller downstream ribs 81 are located radially inward from downstream diffuser grooves 79. A sinuous clearance exists between impeller downstream ribs 81 and downstream diffuser grooves 79 and between downstream diffuser ribs 77 and impeller downstream grooves 83. The sinuous clearance creates a flow path communicating the higher pressure around impeller periphery 64' with downstream pressure cavity 45'. The higher pressure in downstream pressure cavity 45' increases an upstream directed force on impeller 51', tending to cause impeller 51' to move toward the downthrust position.

Figure 4:
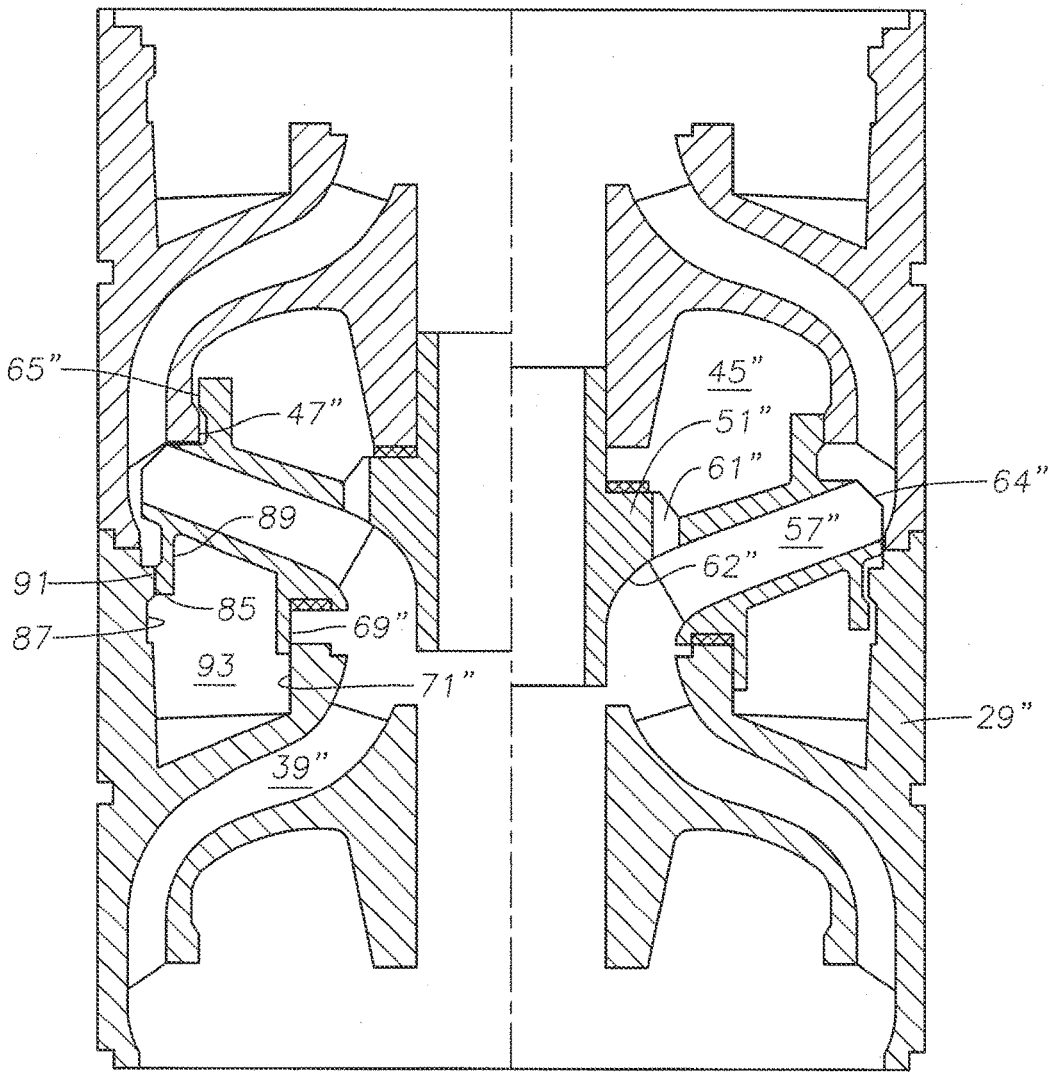
FIG. 4 is a sectional view of one of the pump stages of the pump assembly of FIG. 1, illustrating a third embodiment of an impeller with balance rings, with the left side showing the impeller undergoing upthrust and the right side showing downthrust.

FIG. 4 shows a second alternate embodiment, with the shaft and housing not illustrated, and only a single impeller shown. Components that are essentially the same as in FIG. 2 will use the same reference numerals, but with a double prime symbol. In this embodiment, diffuser rib 47" and impeller rib 65" are the same as in FIG. 2, but alternately, they could be configured as in FIG. 3. In this embodiment, each diffuser 29 has another rib 85 in addition to diffuser rib 47". The second rib 85 is actually downstream of the first diffuser rib 47" of each diffuser 29. However, to be consistent, the second rib 85 will be referred to herein as upstream diffuser rib 85 because it is upstream of and on an upstream diffuser 29 relative to a particular impeller 51. On the other hand, the first rib 47" is downstream relative to the same impeller 51 and is on a downstream diffuser 29". Upstream diffuser rib 85 is an annular protuberance on an inward-facing upper wall surface 87.

Impeller 51" has an upstream balance ring 89 that is concentric with impeller skirt 69" and preferably has a greater diameter. Upstream balance ring 89 has an external, annular impeller upstream rib 91 that has a cylindrical outer surface only slightly less in diameter than a cylindrical inner surface of upstream diffuser rib 85. In this embodiment, upstream balance ring rib 91 has a greater outer diameter than the outer diameter of downstream balance ring rib 65", but that could be changed. A diffuser upstream pressure cavity 93 is defined on an inner side by the close clearance between impeller skirt 69" and diffuser guide surface 71". An outer side of upstream pressure cavity 93 is defined by the interaction of upstream balance ring rib 91 and upstream diffuser rib 85. Although pressure cavity 93 is actually downstream from pressure cavity 45" of the same diffuser 29", it will be referred to herein as upstream pressure cavity 93 because it is located on upstream diffuser 29" and is upstream from impeller 51". The downstream and upstream sides of upstream pressure cavity 93 are defined by an upstream-facing portion of impeller 51" between skirt 69" and upstream balance ring 89, and by a downstream-facing portion of the next upstream diffuser 29" between guide surface 71" and inward-facing wall surface 85.

The upstream pressure cavity 93 of the next upstream diffuser 29" undergoes higher pressure while downstream pressure cavity 45" of the next downstream diffuser 29" undergoes lower pressure and vice versa. While in the maximum downthrust position, as shown on the right side of FIG. 4, upstream balance ring rib 91 is axially spaced upstream relative to upstream diffuser rib 85, opening the flow path between them. The open flow path communicates high pressure from impeller periphery 64" to upstream pressure cavity 93. The higher pressure in upstream pressure cavity 93 exerts a greater downstream-directed force on impeller 51", tending to move impeller downstream from the maximum downthrust position.

At the same time, impeller downstream balance ring rib 65" will be in axial registry with the downstream diffuser rib 47". The sealing or restricted engagement of ribs 47", 65' creates a lower pressure in downstream pressure cavity 45", reducing the upstream-directed force imposed on impeller 51" due to the higher pressure. In this downthrust position, upstream pressure cavity 45" is blocked from communication with the higher pressure at impeller periphery 64", thus bleeds through balance holes 61" into the intake portion of vane passages 57". Consequently, while in the maximum downthrust position, upstream pressure chamber 93 simultaneously increases a downstream-directed force and downstream pressure chamber 45" decreases an upstream-directed force on impeller 51". The two changing forces combine to urge impeller 51" downstream from the maximum downthrust position.

When in the maximum upthrust position shown on the left side of FIG. 4, upstream balance ring rib 91 and upstream diffuser rib 85 are in axial registry with each other, sealing or restricting communication of upstream pressure cavity 93 with impeller periphery 64". Some pressure in upstream pressure cavity 93 can bleed through the interface between skirt 69" and guide surface 71" into impeller intake area 62". Optionally, a port (not shown) could extend downward from upstream pressure cavity 93 into each upstream diffuser passages 39" to allow bleeding off of pressure in upstream pressure cavity 93. The lower pressure in upstream pressure cavity 93 reduces the downstream-directed force imposed on impeller 51. At the same time, the flow path between downstream diffuser rib 47" and downstream balance ring rib 65" opens, which increases the pressure in downstream pressure cavity 45". The increased pressure in downstream pressure cavity 45" urges impeller 51" toward the downthrust position, cooperating with the decreased pressure in upstream pressure cavity 93 to lessen the downstream-directed force on impeller 51". As in the other embodiments, the small clearance between impeller skirt 69" and diffuser guide surface 71" remains constant between the downthrust and upthrust positions.

While the disclosure has been shown in only a few of its forms, it should be apparent to those skilled in the art that it is not so limited but is susceptible to various changes without departing from the scope of the disclosure. For example, although the impeller ribs are shown on an outward-facing surface and the diffuser ribs on an inward-facing surface, that arrangement could be reversed.

The invention claimed is:

1. A submersible pump assembly, comprising:

a submersible motor;

a centrifugal pump operatively connected to the motor, the pump having a longitudinal axis and a plurality of stages, each of the plurality of the stages comprising:

a downstream diffuser and an upstream diffuser;

an impeller located between and in cooperative engagement with the downstream diffuser and the upstream diffuser, the impeller being axially movable relative to the upstream and downstream diffusers between a downthrust position farther from the downstream diffuser and an upthrust position closer to the downstream diffuser;

the impeller having a plurality of vane passages and a plurality of balance holes, each extending from one of the vane passages through a shroud of the impeller;

the downstream diffuser having an annular downstream wall surface, relative to the impeller, defining a downstream cavity in fluid communication with fluid flowing through the balance holes from the van passages, and an annular downstream diffuser protrusion on the downstream wall surface;

the impeller having a downstream balance ring on the shroud of the impeller that encircles the balance holes, the downstream balance ring having an annular downstream balance ring protrusion; and an annular clearance between the downstream balance ring protrusion and the downstream diffuser protrusion that increases in response to the impeller moving from the downthrust position to the upthrust position, the increase in the annular clearance increasing a fluid pressure in the downstream cavity, which acts on the shroud tending to return the impeller to the downthrust position.

2. The pump assembly according to claim 1, wherein:

the downstream diffuser protrusion comprises an annular downstream diffuser rib; and the downstream balance ring protrusion comprises an annular impeller downstream rib that is juxtaposed with the downstream diffuser rib while the impeller is in the downthrust position, defining a minimum dimension of the annular clearance, and wherein the impeller downstream rib moves downstream of the downstream diffuser rib while the impeller is in the upthrust position, defining a maximum dimension of the annular clearance.

3. The pump assembly according to claim 1, wherein:

the downstream diffuser protrusion comprises an annular downstream diffuser rib;

the downstream balance ring protrusion comprises an annular impeller downstream rib;

wherein the impeller downstream rib is axially aligned with the downstream diffuser rib while the impeller is in the downthrust position; and the impeller downstream rib is axially misaligned with the downstream diffuser rib while the impeller is in the upthrust position.

4. The pump assembly according to claim 1, wherein:

the downstream wall surface faces inward toward the axis and the downstream diffuser protrusion has an axial dimension from an upstream side to a downstream side of the downstream diffuser protrusion, and protrudes inward;

the downstream balance ring has an outward facing wall surface and the downstream balance ring protrusion protrudes outward from the outward facing wall surface and has an axial dimension from an upstream side to a downstream side of the downstream balance ring protrusion that is substantially the same as the axial dimension of the downstream diffuser protrusion; and the downstream balance ring protrusion is axially aligned with the downstream diffuser protrusion while the impeller is in the downthrust position, and downstream of the downstream diffuser protrusion while the impeller is in the upthrust position.

5. The pump assembly according to claim 1, wherein:

the downstream diffuser protrusion comprises a plurality of annular downstream diffuser ribs axially spaced apart from each other by annular downstream diffuser grooves;

the downstream balance ring protrusion comprises a plurality of annular impeller downstream ribs axially spaced apart from each other by annular impeller downstream grooves;

wherein the impeller downstream ribs axially align with the downstream diffuser ribs and the impeller downstream grooves axially align with the downstream diffuser grooves while the impeller is in the downthrust position; and the impeller downstream ribs axially align with the downstream diffuser grooves, and the impeller downstream grooves axially align with the downstream diffuser ribs while the impeller is in the upthrust position.

6. The pump assembly according to claim 1, wherein:

fluid within the downstream cavity is in fluid communication with fluid discharged from the vane passages via the annular clearance; and a decrease in the annular clearance that occurs while the impeller moves from the upthrust position toward the downthrust position reduces the fluid pressure in the downstream cavity, tending to return the impeller toward the upthrust position.

7. The pump assembly according to claim 1, wherein:

the upstream diffuser has an annular upstream cavity, relative to the impeller, with an annular wall surface having an annular upstream diffuser protrusion;

the impeller has an annular upstream balance ring having an annular upstream balance ring protrusion; and an annular clearance between the upstream balance ring protrusion and the upstream balance ring protrusion decreases in response to the impeller moving from the downthrust to the upthrust position.

8. The pump assembly according to claim 1, wherein:

the upstream diffuser has an annular upstream cavity, relative to the impeller, with an annular upstream diffuser rib spaced radially outward from a cylindrical guide surface;

the impeller has an annular upstream skirt that has a cylindrical wall surface spaced with a guide surface clearance from the guide surface of the upstream diffuser, the guide surface clearance remaining constant while the impeller moves between the downthrust and upthrust positions; and the pump assembly further comprises, an annular upstream balance ring on the impeller concentric and radially outward from the skirt; and an annular impeller upstream rib on the upstream balance ring that is juxtaposed with the upstream diffuser rib while the impeller is in the upthrust position, and which moves upstream of the upstream diffuser rib while the impeller is in the downthrust position.

9. A submersible pump assembly, comprising:

a submersible motor;

a centrifugal pump operatively connected to the motor, the pump having a longitudinal axis and a plurality of stages through which a rotatable drive shaft extends, each of the plurality of the stages comprising:

an upstream diffuser and a downstream diffuser;

an impeller located between and in mating engagement with the upstream and the downstream diffusers, the impeller having a plurality of vane passages closed on a downstream end by an impeller shroud, the impeller having a plurality of balance holes extending from the vane passages through the shroud, the impeller being axially movable relative to the upstream and downstream diffusers between a downthrust position and an upthrust position, the impeller being further from the downstream diffuser while in the downthrust position than while in the upthrust position;

the downstream diffuser having a downstream diffuser hub with a bore that receives the drive shaft, the downstream diffuser having an inward-facing wall surface radially outward from an outward-facing surface of the downstream diffuser hub, the downstream diffuser having a plurality of diffuser passages located outward from the inward-facing wall surface;

at least one annular downstream diffuser rib protruding inward from the inward-facing wall surface;

the impeller having a downstream balance ring extending downstream from the impeller shroud, the downstream balance ring being located between the inward-facing wall surface and the outward-facing wall surface of the downstream diffuser, the inward-facing and outward facing walls surfaces combining with the downstream balance ring and the impeller shroud to define a downstream fluid pressure cavity in fluid communication with the vane passages via the balance holes;

at least one annular impeller downstream rib on an outer diameter of the downstream balance ring; wherein the impeller downstream rib is axially aligned with and closely spaced from the downstream diffuser rib while the impeller is the downthrust position, restricting communicating of the downstream fluid pressure cavity with a periphery of the impeller to lower a fluid pressure in the downstream fluid pressure cavity, tending to move the impeller toward the upthrust position; and the impeller downstream rib moves downstream relative to the downstream diffuser rib in response to the impeller moving from the downthrust position to the upthrust position, increasing communication of the downstream fluid pressure cavity with fluid at the periphery of the impeller, to increase the fluid pressure in the downstream fluid pressure cavity, tending to move the impeller toward the downthrust position.

10. The pump assembly according to claim 9, wherein the downstream diffuser rib has an axial dimension from an upstream side to a downstream side of the downstream diffuser rib, and the impeller downstream rib has an axial dimension from an upstream side to a downstream side of the impeller downstream rib, and the axial dimensions of the downstream diffuser rib and the impeller downstream rib are the same.

11. The pump assembly according to claim 9, wherein the downstream diffuser rib and the impeller downstream rib have cylindrical surfaces that are concentric with each other and juxtaposed while the impeller is in the downthrust position.

12. The pump assembly according to claim 1, wherein:

the downstream diffuser rib comprises a cylindrical surface joining a conical surface on a downstream side of the downstream diffuser rib; and the impeller downstream rib comprises a cylindrical surface joining a conical surface on an upstream side of the impeller downstream rib.

13. The pump assembly according to claim 9, wherein:

the at least one impeller downstream rib comprises a plurality of impeller downstream ribs axially spaced apart from each other by internal grooves; and the at least one downstream diffuser rib comprises a plurality of downstream diffuser ribs axially spaced apart from each other by internal grooves.

14. The pump assembly according to claim 9, wherein:

the upstream diffuser has an annular upstream pressure cavity, relative to the impeller, with an annular wall surface; and the pump assembly further comprises:

an annular upstream diffuser rib on and protruding from the wall surface of the upstream diffuser;

an annular upstream balance ring on the impeller;

an annular upstream balance ring rib on and protruding from the upstream balance ring; and an annular clearance between the upstream balance ring rib and the upstream diffuser rib that decreases in response to the impeller moving from the downthrust to the upthrust position.

15. The pump assembly according to claim 9, wherein:

the upstream diffuser has an inward-facing wall surface; and the pump assembly further comprises:

an annular upstream diffuser rib on and protruding inward from the inward-facing wall surface of the upstream diffuser;

an upstream balance ring extending upstream from the impeller;

an annular upstream balance ring rib on and protruding outward from the upstream balance ring; and wherein the upstream balance ring rib is axially aligned with and closely spaced to the upstream diffuser rib while the impeller is in the upthrust position, and located upstream of the upstream diffuser rib while the impeller is in the downthrust position.

16. A method of pumping well fluid with a centrifugal pump having a longitudinal axis and a plurality of stages, each of the plurality of the stages comprising an impeller, an upstream diffuser and a downstream diffuser, the impeller being axially movable relative to the upstream diffuser and the downstream diffuser between a downthrust position and an upthrust position, the impeller being farther from the downstream diffuser while in the downthrust position than while in the upthrust position, the impeller having a plurality of vane passages and a plurality of balance holes, each extending from one of the vane passages through a shroud of the impeller, the downstream diffuser having an annular downstream wall surface, relative to the impeller, the impeller having a downstream balance ring; the pump further comprising:

an annular downstream balance ring protrusion on the downstream balance ring;

an annular downstream diffuser protrusion on the downstream wall surface;

an annular clearance between the downstream balance ring protrusion and the downstream diffuser protrusion; the method comprising:

coupling the pump to a motor, the motor rotating the impeller of each stage of the pump to pump the well fluid through the vane passages and divert a portion of the well fluid through the balance holes, then to discharge out the annular clearance;

increasing the annular clearance in response to the impeller moving from the downthrust to the upthrust position and increasing the amount of fluid flowing from the balance holes through the annular clearance; and decreasing the annular clearance in response to the impeller moving from the upthrust to the downthrust position, and decreasing the amount of fluid flowing from the balance holes through the annular clearance.

17. The method according to claim 16, wherein:

increasing the annular clearance decreases a fluid pressure within a downstream pressure cavity of the downstream diffuser; and decreasing the annular clearance increases the fluid pressure within each of the downstream pressure cavities.

18. The method according to claim 16, wherein the upstream diffuser has an annular upstream pressure cavity, the upstream pressure cavity has an annular wall surface, and the impeller has an annular upstream balance ring, the pump further comprising:

an annular upstream diffuser protrusion on the wall surface of the upstream diffuser;

an annular upstream balance ring protrusion on the upstream balance ring;

an annular clearance between the upstream balance ring protrusion and the upstream diffuser protrusion; and wherein the method further comprises:

decreasing the annular clearance between the upstream balance ring and the upstream diffuser protrusion in response to the impeller moving from the downthrust to the upthrust position.

* * * * *